United States Patent [19]

Oshiyama et al.

[11] Patent Number: 4,789,381

[45] Date of Patent: Dec. 6, 1988

[54] FIBER TREATING PROCESS AND COMPOSITION USED THEREFOR

[75] Inventors: Shigeki Oshiyama; Koji Kishimoto; Takeshi Hirota; Shigetoshi Suzue; Hiroyoshi Hiramatsu; Kiyoaki Yoshikawa; Nobuyuki Suzuki, all of Wakayama, Japan

[73] Assignee: Kao Corporation, Tokyo, Japan

[21] Appl. No.: 41,404

[22] Filed: Apr. 23, 1987

[51] Int. Cl.[4] ..... D06M 13/10

[52] U.S. Cl. ..... 8/115.6; 252/8.6

[58] Field of Search ..... 8/115.6

[56] References Cited

U.S. PATENT DOCUMENTS

| | | | |
|---|---|---|---|
| 3,177,143 | 4/1965 | Lense | 252/8.9 |
| 3,368,917 | 2/1968 | Belcher | 117/138.8 |
| 4,103,068 | 7/1978 | Marshall | 428/395 |
| 4,144,178 | 3/1979 | Katabe | 252/8.9 |
| 4,144,183 | 3/1979 | Koch | 252/56 S |

FOREIGN PATENT DOCUMENTS

| | | |
|---|---|---|
| 0157583 | 10/1985 | European Pat. Off. . |
| 2415651 | 10/1975 | Fed. Rep. of Germany . |
| 7229474 | 8/1972 | Japan . |

OTHER PUBLICATIONS

"Lubricants for Textile Fibers", 84(8) Chemical Abstracts 99, No. 45982x.

*Primary Examiner*—Paul Lieberman
*Assistant Examiner*—Isabelle Rodriquez
*Attorney, Agent, or Firm*—Birch, Stewart, Kolasch & Birch

[57] ABSTRACT

Disclosed herein is a fiber treating process which comprises treating fibers.

An ester formed by the union of an polybasic carboxylic acid and a compound represented by the formula below

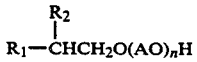

where $R_1$ and $R_2$ represent $C_4$–$C_{18}$ alkyl groups; AO represents a $C_2$–$C_4$ alkyleneoxide group; and n represents an integer of 0 to 30.

5 Claims, No Drawings

FIBER TREATING PROCESS AND COMPOSITION USED THEREFOR

BACKGROUND OF THE INVENTION

1. Field of the Invention

The present invention relates to a process for treating synthetic fibers, and more particularly, it relates to a process for treating synthetic fibers which undergo severe heat treatment.

2. Description of the Prior Art

In the production of synthetic fibers such as polyester fibers and polyamide fibers, the filaments formed by melt-spinning are drawn with heating under a high load and undergo heat-setting to optimize the physical properties of fibers. Drawing is performed under severe conditions (in terms of load and temperature) especially in the production of the rubber reinforcing yarns (such as tire cord), raw yarns for seat belts, and raw yarns for ropes. Recently, filament yarns are produced under severer conditions than before because they are treated at a considerably high speed for the rationalization of processes and the improvement of productivity. In production under more severe conditions, filament yarns are subject to fuzzing and breakage on account of increased friction with many objects, which not only decreases productivity but also aggravates the physical properties of fibers. When filament yarns undergo severe heat treatment, the finishing agent pyrolyzes or thermally polymerizes, giving off smoke and aggravating the working environment. In addition, decomposition products or polymerized products in tar-like form contaminate eyelets, causing clinging and breakage of single yarns. This prevents smooth drawing and false twisting and forces one to suspend operation for cleaning.

In order to eliminate such troubles leading to a decrease of efficiency, there have been used lubricating agents having comparatively good heat resistance, such as mineral oil, esters of higher alcohols and fatty acids, esters of dibasic acids such as adipic acid and sebacic acid, esters of dihydric alcohols such as neopentyl glycol and 1,6-hexanediol) and higher fatty acids, and fatty acid esters of polyhydric alcohols (e.g., trimethylolpropane and glycerin). However, they are not necessarily satisfactory. To meet the requirements for a lubricating agent for synthetic fibers which undergo heat treatment, there was proposed a finishing agent in Japanese Patent Publication No. 29474/1972 and Japanese Patent Laid-open No. 70397/1976. It contains a diester formed by adding alkylene oxides to bisphenol-A and then esterifying the adduct with a higher fatty acid. This diester is very good in heat resistance but is not necessarily satisfactory in lubricating performance on account of excessively high viscosity.

Other prospective compounds having good heat resistance are branched alkyl esters which are obtained from oxo-alcohol or a branched fatty acid obtained by oxidation of oxo-alcohol or from isostearic acid (methyl branched), available from Emery in the U.S., or isostearyl alcohol obtained by reduction of isostearic acid. They are not readily liquefied at room temperature, and they are not necessarily satisfactory in heat resistance.

SUMMARY OF THE INVENTION

In order to solve the above-mentioned problems, the present inventors carried out research, which led to the findings that fibers can have satisfactory lubricity even under severe conditions if they are treated with a specific compound. Accordingly, it is an object of the present invention to provide a fiber treating process which comprises treating fibers with one member selected from the following two compounds (a) and (b).

(a) An ester formed by the union of a polybasic carboxylic acid and a compound represented by the formula (1) below.

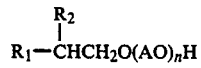

$$R_1-\overset{\overset{\displaystyle R_2}{|}}{C}HCH_2O(AO)_nH \qquad (1)$$

(where $R_1$ and $R_2$ represent $C_4$–$C_{18}$ alkyl groups; AO repesents a $C_2$–$C_4$ alkyleneoxide group; and n represents an integer of 0 to 30.)

(b) An ester formed by the union of a polyhydric alcohol and a compound represented by the formula (2) below.

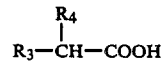

$$R_3-\overset{\overset{\displaystyle R_4}{|}}{C}H-COOH \qquad (2)$$

(where $R_3$ and $R_4$ represent $C_4$–$C_{18}$ alkyl groups.)

The compound represented by the formula (1) is a branched alcohol obtained by the so-called Guerbet reaction or, if necessary, a compound formed by the addition of a $C_2$–$C_4$ alkylene oxide to the branched alcohol. The polybasic carboxylic acid for the compound of the formula (1) include dibasic ones such as maleic acid, succinic acid, adipic acid, azelaic acid, phthalic acid, and anhydrides thereof, and tribasic ones such as trimellitic acid and anhydride thereof.

The compound represented by the formula (2) is a branched fatty acid formed by oxidation of the branched alcohol obtained by the so-called Guerbet reaction, or a branched fatty acid obtained by the addition reaction of an α-olefin and a fatty acid. The polyhydric alcohol for the compound represented by the formula (2) includes dihydric ones such as ethylene glycol, propylene glycol, trimethylene glycol, butanediol, hexanediol, diethylene glycol, neopentyl glycol, and butenediol; trihydric ones such as glycerin, trimethylol ethane, and trimethylol propane; and quadrihydric ones such as pentaerythritol and sorbitan. If necessary, these compounds may contain $C_2$–$C_4$ alkylene oxides added.

The polyhydric alcohol may also include the compounds represented by the formula (3) below.

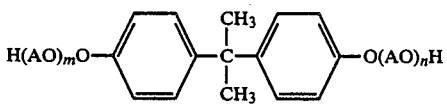

(3)

(where AO denotes an alkylene oxide group in which A is a $C_2$–$C_4$ alkylene group; and m and n are 0 or integers of 1 to 30, with the sum thereof being less than 50.)

The compound represented by the formula (3) is one which is obtained by the addition of $C_2$–$C_4$ alkylene oxides to bisphenol A. The total amount of addition should preferably be less than 50. With an addition in excess of 50, the resulting compound is poor in heat resistance and the present invention does not fully exhibits its effect. The $C_2$–$C_4$ alkylene oxide includes, for example, ethylene oxide, propylene oxide, and butylene oxide. They may be used individually or in combination with one another.

The esterification reaction may be carried out by a known method, such as dehydration with heating in the presence of an alkali or acid catalyst. Complete esterification is desirable for lubricity.

The ester compound of the invention is superior in heat resistance and lubricity owing to its unique structure. The compound represented by the formula (a) is preferable. Among the compounds represented by the formula (a), those in which the polybasic carboxylic acid is an aliphatic polybasic carboxylic acid are superior in heat resistance, lubricity, and viscosity to those in which the polybasic carboxylic acid is an aromatic polybasic carboxylic acid.

The most typical ester compounds are di 2-hexyldecyl sebacate, di 2-hexyldecyl succinate and di 2-octyldodecyl adipate.

In the working of the present invention, it is preferable to use an emulsifier in combination with the ester compound (a) or (b) in a ratio of 10/90 to 90/10 by weight.

The emulsifier for this purpose includes a variety of surface active agents. Preferable among them are nonionic surface active agents, particularly polyoxyalkylene-added nonionic surface active agents such as polyoxyalkylene alkyl (or alkenyl) ether, polyoxyalkylene alkylphenyl ether, polyoxyalkylene alkylphenyl ether, polyoxyalkylene fatty acid ester, polyoxyalkylene sorbitan fatty acid ester, polyoxyalkylene sorbitol fatty acid ester, polyoxyalkylene sorbitol alkyl ether, alkylene oxide adduct of natural oil or fat or hydrogenated product thereof, and alkylene oxide adduct of a mixture of natural oil or fat and polyhydric alcohol.

The composition of the present invention may also be incorporated with any known antistatic agent such as a quaternary ammonium salt, alkylphosphate potassium salt, potassium oleate, imidazoline amphoteric surface active agent, and betaine amphoteric surface active agent.

Furthermore, the composition of the invention may be incorporated with, according to need, any known lubricant and emulsifier in an amount not detrimental to the effect of the present invention. The lubricants include fatty acid monoesters (e.g., lauryl oleate and isotridecyl stearate), dibasic acid diesters (e.g., dioleyl adipate and dioctyl phthalate), and polyhydric alcohol esters (e.g., trimethylolethane trilaurate and glycerin trioleate). The emulsifiers include an ethylene oxide adduct of hardened castor oil.

According to the present invention, the finishing agent for the treatment of synthetic fibers may be used in the form of an aqueous emulsion or a solution in a low-viscosity diluent. The emulsion or solution may be applied to the filament yarn by spraying or by the use of an oiling roller. The amount of application is 0.2 to 2.0 wt%.

The finishing agent of the invention imparts outstanding heat resistance to synthetic fibers. The treated synthetic fibers, when passed on a heater plate heated at 160°-250° C., do not form a tar-like substance which is a hindrance to efficient operation.

Furthermore, the finishing agent of the invention exhibits good lubricity at high temperatures and under high loads. Therefore, it is suitably applied to thermoplastic fibers such as polyamide, polyester, and polypropylene to be used as raw yarns for false twist yarns, sewing yarns, and tire cords which undergo severe processes.

The invention is now described in more detail with reference to the following examples, which should not be construed to limit the scope of the invention.

EXAMPLE 1

The compounds of the invention as shown in Table 1 were compared in heat resistance with known lubricants as shown in Table 2. The heat resistance was indicated by the tar forming ratio (%). The results are shown in Table 2. It is to be noted from Table 2 that the compounds of the invention have outstanding heat resistance, with no formation of tar-like substance.

The tar forming ratio (%) was measured in the following manner. Place about 0.5 g of sample in an aluminum dish. Heat the sample in a hot-air oven at 250° C. for 4 hours. Allow the sample to cool to room temperature, and wash the aluminum dish with acetone. Weigh the amount of black resinous residues remaining undissolved in acetone. Calculate the tar forming ratio (%) as follows:

$$\text{Tar forming ratio (\%)} = \frac{\text{Weight (g) of acetone insolubles}}{\text{Weight (g) of sample taken}} \times 100$$

TABLE 1

| Designation | Structural formula |
|---|---|
| A | $C_{10}H_{21}-CH(C_8H_{17})CH_2OC(=O)C_{17}H_{35}$ |
| B | $C_9H_{19}-CH(C_7H_{15})CH_2OC(=O)CH(C_7H_{15})C_9H_{19}$ |
| C | $C_{10}H_{21}-CH(C_8H_{17})CH_2OC(=O)CH_2CH_2CH_2CH_2C(=O)OCH_2CH(C_8H_{17})C_{10}H_{21}$ |
| D | $C_9H_{19}-CH(C_7H_{15})COH_2C-C(CH_3)_2-CH_2OC(=O)CH(C_7H_{15})C_9H_{19}$ |
| E | $C_{10}H_{21}-CH(C_8H_{17})CH_2OC(=O)(CH_2)_mCH(CH_3)(CH_2)_nCH_3$ <br> $m + n = 14$ |

TABLE 1-continued

| Designation | Structural formula |
|---|---|
| F | 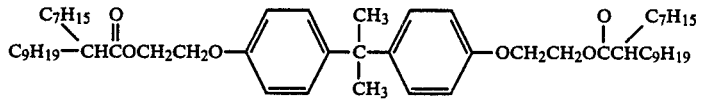 |
| G | 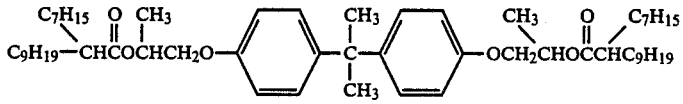 |

TABLE 2

| Name of Lubricant | Tar-forming ratio (%) |
|---|---|
| Example of the invention | |
| Compound A | 0.0 |
| Compound B | 0.0 |
| Compound C | 0.0 |
| Compound D | 0.0 |
| Compound E | 0.0 |
| Compound F | 0.0 |
| Compound G | 0.0 |
| Comparative Example | |
| 1,6-Hexanediol dioleate | 42.4 |
| Oleyl oleate | 43.5 |
| Diglycerin dilaurate | 28.8 |
| Compound disclosed in Japanese Patent Publication No. 29474/1972* | 0.0 |
| Dilauryl adipate | 26.3 |
| Disteary fumarate | 13.7 |
| Diisostearyl (methyl branched) phthalate | 15.2 |
| Ditridecyl (oxo) sebacate | 25.7 |

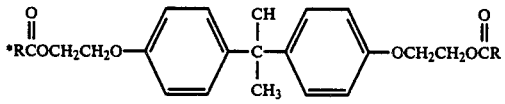

(R = $C_{11}H_{23}$)

EXAMPLE 2

The compounds of the invention as shown in Table 1 were compared in lubricity with known lubricants as shown in Table 3. Lubricity was evaluated by measuring the coefficient of friction with metal of sample yarn running at 200° C. The sample yarn was prepared by applying the lubricant in an amount of 1% to commercial nylon tire cord (1260 d) which had previously been de-oiled and dried. The results are shown in Table 3.

TABLE 3

| Name of Lubricant | Coefficient of friction 0.5 m/min | 100 m/min | 500 m/min |
|---|---|---|---|
| Example of the invention | | | |
| Compound A | 0.100 | 0.250 | 0.270 |
| Compound B | 0.110 | 0.255 | 0.260 |
| Compound C | 0.085 | 0.245 | 0.255 |
| Compound D | 0.120 | 0.260 | 0.295 |
| Compound E | 0.115 | 0.255 | 0.265 |
| Compound F | 0.120 | 0.410 | 0.445 |
| Compound G | 0.118 | 0.405 | 0.443 |
| Comparative Example | | | |
| 1,6-Hexanediol dioleate | 0.135 | 0.305 | 0.365 |
| Oleyl oleate | 0.135 | 0.260 | 0.285 |
| Diglycerin dilaurate | 0.150 | 0.315 | 0.375 |
| Compound disclosed in Japanese Patent Publication No. 29474/1972* | 0.120 | 0.405 | 0.440 |
| Dilauryl adipate | 0.130 | 0.266 | 0.275 |
| Distearyl fumarate | 0.123 | 0.265 | 0.295 |
| Diisostearyl (methyl branched) phthalate | 0.120 | 0.255 | 0.305 |

TABLE 3-continued

| Name of Lubricant | Coefficient of friction 0.5 m/min | 100 m/min | 500 m/min |
|---|---|---|---|
| Ditridecyl (oxo) sebacate | 0.133 | 0.277 | 0.280 |

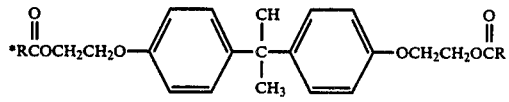

(R = $C_{11}H_{23}$)

EXAMPLE 3

A finishing agent containing Compound A of the invention was compared in processability with a conventional one as shown in Table 4 in the following manner. A nylon-66 filament yarn (70 d, 24-filaments) was oiled with a 10 wt% aqueous emulsion at a loading of 0.6%. The yarn was stretched 3.4 times at a running rate of 450 m/min. with two pairs of rollers. The yarn was observed over a hot plate, located between the two pairs of rollers, to examine the properties during the drawing step. The stretched yarn then underwent false twisting at a running rate of 120 m/min. by using a spindle type false twister. The yarn textured this way was examined in its properties. Results are shown in Table 5.

It is noted from Table 5 that the finishing agent of the invention is superior in both drawing and processing.

TABLE 4

| Designation | Composition of finishing agent | |
|---|---|---|
| A | Compound A | 60 |
| | Castor oil $EO_{12}$ | 15 |
| | Lauryl alcohol $EO_7$ | 15 |
| | Potassium lauryl phosphate | 10 |
| K | Mineral oil (60 sec) | 40 |
| | 2-Ethylhexyl palmitate | 20 |
| | Castor oil $EO_{12}$ | 10 |
| | Sperm alcohol $EO_4$ | 10 |
| | Lauryl alcohol $EO_7$ | 10 |
| | Potassium lauryl phosphate | 10 |

TABLE 5

| Items | Finishing agent A | Finishing agent K |
|---|---|---|
| over the hot plate of the drawing step | | |
| Fuming | little | much |
| Staining on hot plate | little | considerable |
| Breakage (%) | 1 | 3 |
| after the twisting step | | |
| Deposit of white powder on outlet of spinneret | little | much |
| properties of the textured yarn | | |
| Yarn strength (g/d) | 4.5 | 4.2 |
| Number of twist (t/m) | 3500 | 3100 |

TABLE 5-continued

| Items | Finishing agent A | Finishing agent K |
|---|---|---|
| Crimp recovery ratio (%) | 43 | 40 |

What is claimed is:

1. A fiber treating process comprising treating fibers with an ester formed from a polybasic carboxylic acid and a compound having the formula $$R_1-\overset{\overset{R_2}{|}}{C}HCH_2O(AO)_nH$$

wherein $R_1$ and $R_2$ represents $C_4$–$C_{18}$ alkyl groups; AO represents a $C_2$–$C_4$ alkyleneoxide group; and n represents an integer of 0 to 30.

2. A fiber treating composition comprising an ester formed from a polybasic carboxylic acid and a compound having the formula $$R_1-\overset{\overset{R_2}{|}}{C}HCH_2O(AO)_nH$$

wherein $R_1$ and $R_2$ represent $C_4$–$C_{18}$ alkyl groups; AO represents a $C_2$–$C_4$ alkyleneoxide group; and n represents an integer of 0 to 30, and an emulsifier in a ratio of 10/90 to 90/10 by weight of the ester compound.

3. A fiber treating process which comprises treating fibers with a fiber treating composition according to claim 2.

4. A fiber treating process according to claim 1 wherein the ester compound is selected from the group consisting of di 2-hexyldecyl sebacate, di 2-hexyldecyl succinate and di 2-octyldodecyl adipate.

5. A fiber treating process according to claim 2 wherein the ester compound is selected from the group consisting of di 2-hexyldecyl sebacate, di 2-hexyldecyl succinate and di 2-octyldodecyl adipate.

* * * * *